US006191539B1

(12) United States Patent
Green

(10) Patent No.: US 6,191,539 B1
(45) Date of Patent: Feb. 20, 2001

(54) FLUORESCENT LAMP WITH INTEGRAL CONDUCTIVE TRACES FOR EXTENDING LOW-END LUMINANCE AND HEATING THE LAMP TUBE

(75) Inventor: John R. Green, Seattle, WA (US)

(73) Assignee: Korry Electronics Co, Seattle, WA (US)

( * ) Notice: Under 35 U.S.C. 154(b), the term of this patent shall be extended for 0 days.

(21) Appl. No.: 09/276,948

(22) Filed: Mar. 26, 1999

(51) Int. Cl.[7] ..... H05B 41/16

(52) U.S. Cl. ..... 315/249; 315/291; 315/112; 315/DIG. 1

(58) Field of Search ..... 315/249, 248, 315/246, 291, DIG. 1, 112, 115, 160, 335, DIG. 4; 313/46, 467

(56) References Cited

U.S. PATENT DOCUMENTS

| | | | | |
|---|---|---|---|---|
| 3,535,576 | | 10/1970 | Skildum | 313/112 |
| 3,919,579 | | 11/1975 | Lemmers | 313/273 |
| 4,329,622 | | 5/1982 | Corona et al. | 315/49 |
| 4,370,600 | | 1/1983 | Zansky | 315/244 |
| 4,516,057 | | 5/1985 | Proud et al. | 315/260 |
| 4,521,718 | | 6/1985 | Bysewski et al. | 315/299 |
| 4,538,092 | | 8/1985 | Goralnik | 315/58 |
| 4,559,479 | | 12/1985 | Munson | 315/239 |
| 4,645,974 | | 2/1987 | Asai | 315/50 |
| 4,717,863 | | 1/1988 | Zeiler | 315/307 |
| 4,739,227 | | 4/1988 | Anderson | 315/260 |
| 4,798,997 | | 1/1989 | Egami et al. | 315/115 |
| 4,851,734 | | 7/1989 | Hamai et al. | 313/493 |
| 5,013,966 | | 5/1991 | Saikatsu et al. | 315/335 |
| 5,030,894 | * | 7/1991 | Yoshiike et al. | 315/335 |
| 5,105,127 | | 4/1992 | Lavaud et al. | 315/307 |
| 5,172,034 | | 12/1992 | Brinkerhoff | 315/291 |
| 5,194,782 | | 3/1993 | Richardson et al. | 315/307 |
| 5,214,351 | | 5/1993 | Nieda | 315/219 |
| 5,311,104 | | 5/1994 | Antle | 315/291 |
| 5,406,174 | | 4/1995 | Slegers | 315/219 |
| 5,420,481 | * | 5/1995 | McCanney | 315/DIG. 1 |
| 5,434,881 | | 7/1995 | Welsch et al. | 372/87 |
| 5,525,872 | | 6/1996 | Achten et al. | 315/291 |
| 5,592,052 | * | 1/1997 | Maya et al. | 315/248 |
| 5,604,410 | * | 2/1997 | Vollkommer et al. | 315/246 |
| 5,747,946 | * | 5/1998 | Tyler | 315/291 |
| 5,965,988 | * | 10/1999 | Vollkommer et al. | 315/246 |

* cited by examiner

*Primary Examiner*—Don Wong
*Assistant Examiner*—Thuy Vinh Tran
(74) *Attorney, Agent, or Firm*—Christensen O'Connor Johnson Kindness PLLC

(57) ABSTRACT

A fluorescent lamp (10) includes a tube (12) and a fluorescent gas mixture sealed in the tube. A phosphor layer (20) is deposited on the interior surface of the tube. A pair of internal electrodes (14), connected by a first circuit (16) to a first power supply (18), are located in the tube at opposite ends thereof. The first power supply (18) causes a high-intensity arc discharge between the pair of internal electrodes (14) and, in turn, produces fluorescent light. An opposing pair of conductive traces (22, 24) connected by a second circuit (26) to a second power supply (28), are silk-screened onto the exterior surface of the lamp tube (12) along the length thereof. The second power supply (28) causes the opposing pair of conductive traces (22, 24) to produce a transverse electric field that creates a low-intensity transverse discharge. The low-intensity transverse discharge is used to lower the luminance range of the fluorescent lamp. The conductive traces are formed of a conductive frit, such as a silver ceramic frit. After silk-screening, the lamp tube (12) is fired to melt the frit onto the tube. At least one of the conductive traces (22, 24) is connected by a third circuit (30) to a third power supply (31). The resistivity of this conductive trace is such that the conductive trace functions as a heater when it receives power from the third power supply.

36 Claims, 9 Drawing Sheets

FLUORESCENT LAMP WITH INTEGRAL CONDUCTIVE TRACES FOR EXTENDING LOW-END LUMINANCE AND HEATING THE LAMP TUBE

FIELD OF THE INVENTION

The present invention relates to fluorescent lamps and, more particularly, to the luminance range and warmup capability of fluorescent lamps.

BACKGROUND OF THE INVENTION

Fluorescent lamps are used as light sources in a wide variety of applications. These applications include consumer and industrial applications, such as home and office lighting. Fluorescent lamps are also used in a number of more demanding applications, for example, for backlighting displays, such as liquid crystal displays (LCDs) and active matrix liquid crystal displays (AMLCDs). LCDs and AMLCDs are used in a variety of products including aircraft flight instruments and portable computers.

A fluorescent lamp, especially when used for backlighting an LCD and an AMLCD in an aircraft application, particularly a military aircraft application, should have a wide luminance range. In addition to having a wide luminance range, the fluorescent lamp should be dimmable to a low luminance level so that a pilot or other user can view the display screen easily under both bright and dark conditions, including night vision goggle (NVG) conditions. Further, the light output of a fluorescent lamp, especially when used for backlighting an LCD or AMLCD in a military aircraft application, should reach its optimum operating level shortly after the lamp is turned on in cold climates. Achieving these two goals has been difficult, as will become apparent from the following discussion.

A typical fluorescent lamp includes a glass tube that contains a gas mixture of mercury and one or more rare gasses, such as argon and neon. A pair of internal electrodes are located inside the glass tube, spaced apart from each other along the length of the tube. The interior wall of the glass tube is coated with a phosphor material. Various ways of causing the internal electrodes to emit electrons in the glass tube are available. For example, a high AC voltage may be applied across the internal electrodes to cause an arc discharge that results in the release of electrons (cold cathode tube). Alternatively, or in addition, if the internal electrodes are in the form of filaments, a filament current may be applied to both internal electrodes to thermionically excite the electrodes to emit electrons (hot cathode tube). The released electrons driven by the applied high AC voltage excite the gas mixture, ionize some gas molecules, and trigger an arc discharge across the internal electrodes, i.e., electric conduction occurs between the internal electrodes. The mercury atoms in the gas mixture are excited to upper energy levels, and some of them emit ultraviolet (UV) radiation when returning to their ground state. When the UV radiation strikes a phosphor coating deposited on the interior wall of the glass tube, the phosphor produces visible light.

Lumination is controlled by controlling the output of the power supply that causes the arc discharge current. Amplitude or pulse width control can be used. Pulse-width modulation (PWM) controls how often the arc discharge current flows, whereas amplitude control controls the magnitude of the arc discharge current. FIG. 1 illustrates the waveform of three arc discharge currents and, hence, the light output. The first and second arc discharge currents 11 and 12 have high and low amplitudes, respectively. Both are continuous AC sinusoids. The third arc discharge current 13 is a pulse-width modulated version of the first arc discharge current. The first arc discharge current 11 produces a bright output. The second arc discharge current 12 produces a dim output. The third arc discharge current 13 also produces a dim output.

At any given frequency, the range of amplitude control is limited at the low end by the minimum level of voltage required to sustain an arc discharge. Operation below this level requires the use of a reignition pulse to provide a minimum level of ionization. For example, in a pulse-width modulated (PWM) dim mode of operation, the ionized species in the gas mixture, such as $Hg^+$, $Ar^+$, and $e^-$ that are necessary for stable discharge operation, decay rapidly during the inactive periods between pulse cycles. The ionization decay time is approximately 100 microseconds, as compared to a typical pulse period of 8 milliseconds. Therefore, a reignition pulse is needed to provide a minimum level of ionization in the gas mixture prior to arrival of the next group of excitation pulses. However, the reignition pulse and the resulting ionization create light. Even the smallest reignition pulse, reduced to the minimum pulse width necessary to ionize the gas mixture, creates light that is brighter than the minimum luminance level typically required for dim operation. As a result, it has been difficult to extend the lower limit of the dimming range of a fluorescent lamp.

One approach to lowering the dimming rage of a fluorescent lamp is found in U.S. Pat. No. 5,420,481 to McCanney. As illustrated in FIG. 2A, McCanney proposed the use of a pair of external conducting plates 4, located on opposite sides of a fluorescent lamp tube 5. The pair of external conducting plates 4 produce a transverse electric field through the tube 5. The transverse electric field produces a low-intensity transverse discharge across the plates 4, and maintains a minimum level of ionization in the gas mixture. This eliminates the need for the use of reignition pulses and, thus, extends the lower limit of the lamp's dimming range. Alternatively, as illustrated in FIG. 2B, a pair of external wires 6, attached to opposite sides of the glass tube 5, can be used to create a transverse electric field. Further alternatively, as illustrated in FIG. 2C, a printed wiring board (PWB) 7 including a pair of conductive traces 8 along the tube 5 can be used to create a transverse electric field. The McCanney devices, however, suffer some limitations. It is difficult to secure plates, wires, or a PWB to a lamp having a curved or serpentine shape. (Serpentine-shaped lamps are ideally suited for use in AMLCD and LCD backlights). It is particularly difficult to arrange the wires or the conductive traces on a PWB to precisely follow a complex lamp tube geometry. For example, in the case of PWB electrodes, the efficiency of the electric field ionization is dependent on the proximity of the conductive traces to the glass tube. Since a glass tube is typically bent into various forms by hand, it is extremely difficult to exactly align the glass tube with the printed traces on a wiring board. When close and consistent alignment is not achieved, higher voltages are required to produce a transverse electric field adequate to produce a transverse discharge. Further, the intensity of the discharge will vary along the length of the discharge. Furthermore, it is difficult to handle lamps having plates, wires or a PWB with conductive traces during manufacturing. Thus, a need exists for a fluorescent lamp with an extended lower limit dimming range that is easy to handle during the manufacture of products incorporating the fluorescent lamp, and that provides a uniform low intensity luminance level throughout the length of the lamp.

Another challenge associated with fluorescent lamps is the need to warm up the tube of the lamp in order to reach the lamp's optimal light output level. This challenge is particularly difficult to meet in fluorescent lamps intended for use in products designed for operation in cold climates, such as LCD and AMLCD instruments designed for use in military aircraft intended for possible use in arctic regions. More specifically, the light output of a fluorescent lamp depends on the mercury vapor pressure within the lamp's glass tube, and the mercury vapor pressure varies depending upon the temperature of the glass tube. FIG. 3 shows that, for a fluorescent lamp having a small diameter glass tube, such as 15 mm, the optimum temperature for maximum light output is about 50° C. When the temperature is below the optimum temperature, mercury atoms are condensed on the wall of the glass tube and/or other cold internal surfaces of the lamp, such as the electrode leads. As a result, the mercury vapor density within the glass tube decreases. As the mercury vapor density decreases, the UV radiation production rate decreases. Hence, the visible light output from the lamp decreases.

One method of increasing mercury vapor pressure is to increase the wall temperature of a fluorescent lamp's glass tube. In the past, this has been accomplished by passing an electrical current through a resistive, small-diameter heater wire wrapped around the exterior of the glass tube. The application of the resistive wire is typically accomplished by winding the wire in a spiral fashion along the length of the glass tube. Such winding becomes complicated when the glass tube has a nonlinear configuration, such as a serpentine configuration, particularly where the glass tube bends. Further, the point contacts that occur between a resistive wire wrapped around a glass tube and the glass tube result in poor heat transfer between the wire and the glass tube. In addition, in order to prevent the wire from unraveling from the glass tube, an adhesive is typically applied over the wire at periodic intervals along the glass tube. The adhesive further diminishes the rate of heat transfer between the wire and the glass tube. As a result, more power than desired must be applied to the wire to raise the temperature of the glass tube to the desired level. Furthermore, from a manufacturing viewpoint, it is difficult to bond a resistive wire to a glass tube such that the wire is in intimate contact with the tube. Thus, a need exists for a fluorescent lamp design having a heater that has a high heat transfer rate and is easy to manufacture.

The present invention is directed to providing a fluorescent lamp with an extended low end dimming range and rapid warmup capability that is easy to handle during the manufacture of products incorporating the fluorescent lamp. While primarily designed for use in the backlights of LCD and AMLCD displays designed for use in low-temperature environments, such as AMLCD and LCD flight instrument displays designed for use in military aircraft, fluorescent lamps formed in accordance with the present invention may also find use in other environments.

SUMMARY OF THE INVENTION

In accordance with this invention, a fluorescent lamp with extended low end dimming range and rapid warmup capability is provided. The lamp includes a tube and a fluorescent gas mixture sealed inside the tube. The interior of the tube is coated with a phosphor material. A pair of internal electrodes are located inside the tube. A pair of external electrodes in the form of conductive traces are directly applied to the exterior surfaces of the tube along the length of the tube, on opposite sides thereof. The pair of internal electrodes and the pair of conductive traces are connected to suitable power supplies. When a predetermined voltage is applied across the conductive traces, a transverse electric field sufficient to create a low-intensity transverse discharge is created between the conductive traces. The low-intensity transverse discharge maintains a minimum level of ionization within the gas mixture, thereby extending the lower limit of the dimming range of the fluorescent lamp.

In accordance with other aspects of this invention, the power supplies that supply power to the pair of internal electrodes and the pair of conductive traces are formed by a common power supply.

In accordance with further aspects of this invention, at least one of the conductive traces is connected to a further power supply. When power is applied to the at least one conductive trace by the further power supply, the current flow through the at least one conductive trace produces heat sufficient for the at least one conductive trace to also function as a heater. The thus provided heat rapidly warms up the wall of the lamp tube so that even in cold temperatures the fluorescent lamp quickly reaches its optimal light output level.

In accordance with still further aspects of this invention, preferably, the conductive traces are formed by a conductive frit, such as a silver ceramic frit. The conductive frit is pattern-implanted (for example, silk-screened) onto the tube, and the glass tube fired to melt the frit onto the tube.

The present invention further provides a method of forming a fluorescent lamp with external conductive traces located on the exterior of the fluorescent lamp tube. The method comprises: providing a tube; pattern-imprinting conductive traces onto the exterior surface of the tube; firing the tube; applying a phosphor coating to the interior surface of the tube; injecting a fluorescent gas mixture into the tube; and sealing the tube. Pattern-imprinting and firing of the conductive traces take place before application of the phosphor coating because typical firing temperatures would be damaging to a preapplied phosphor coating.

As will be readily appreciated from the foregoing description, the invention provides a fluorescent lamp with an extended low end dimming range and rapid warmup capability when compared with prior fluorescent lamps, and an improved method of making such lamps. The application of a pair of conductive traces directly to the exterior of the tube of a fluorescent lamp formed in accordance with the invention eliminates the manufacturing handling and other disadvantages of fluorescent lamps of the type illustrated in FIGS. 2A–2C and described above. The use of a conductive trace applied directly to the exterior of a fluorescent lamp tube to generate heat improves warmup capability in a manner that avoids the problems associated with wrapping a resistive wire around a fluorescent lamp tube.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
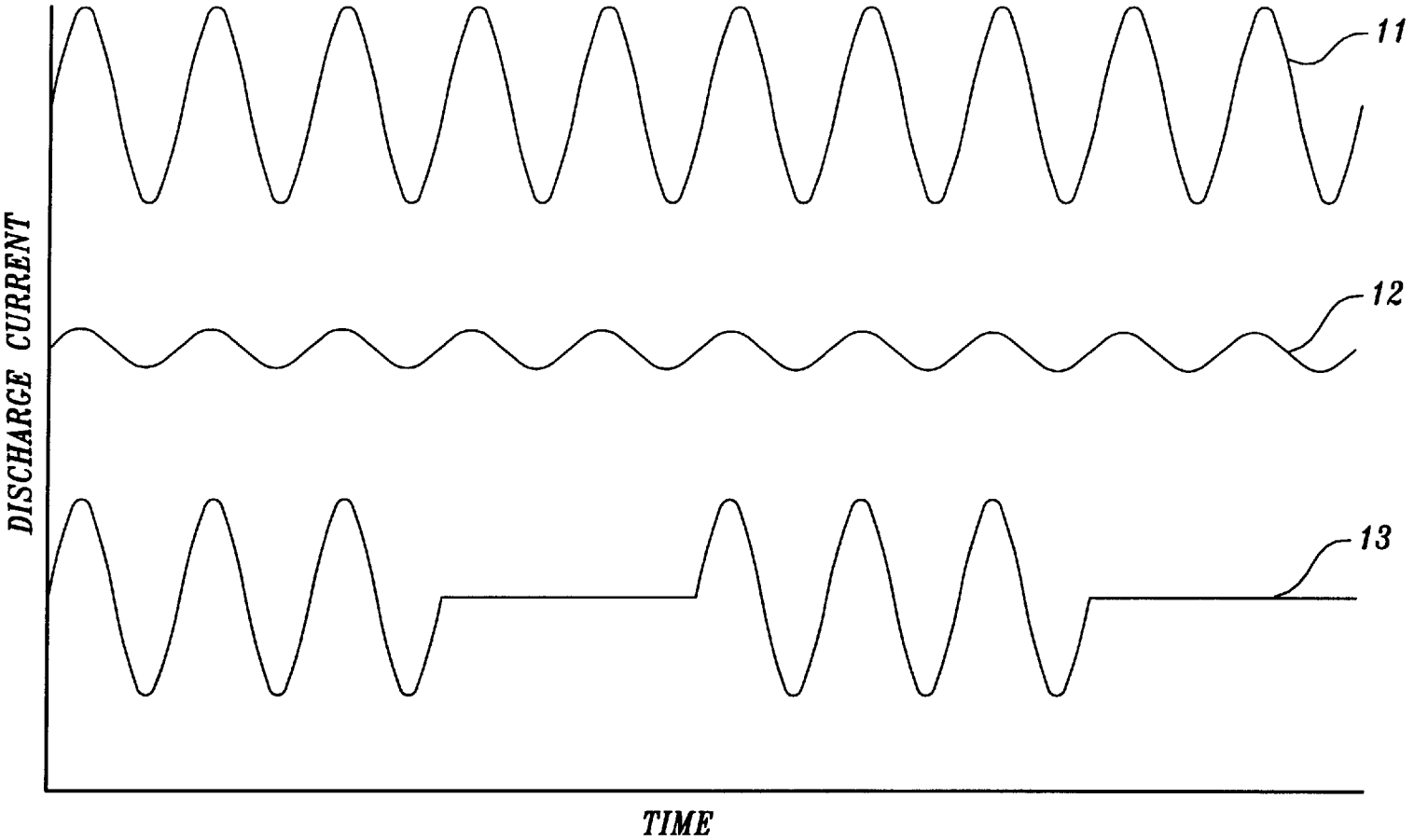
FIG. 1 illustrates three typical fluorescent lamp arc discharge currents.
Figure 2A:
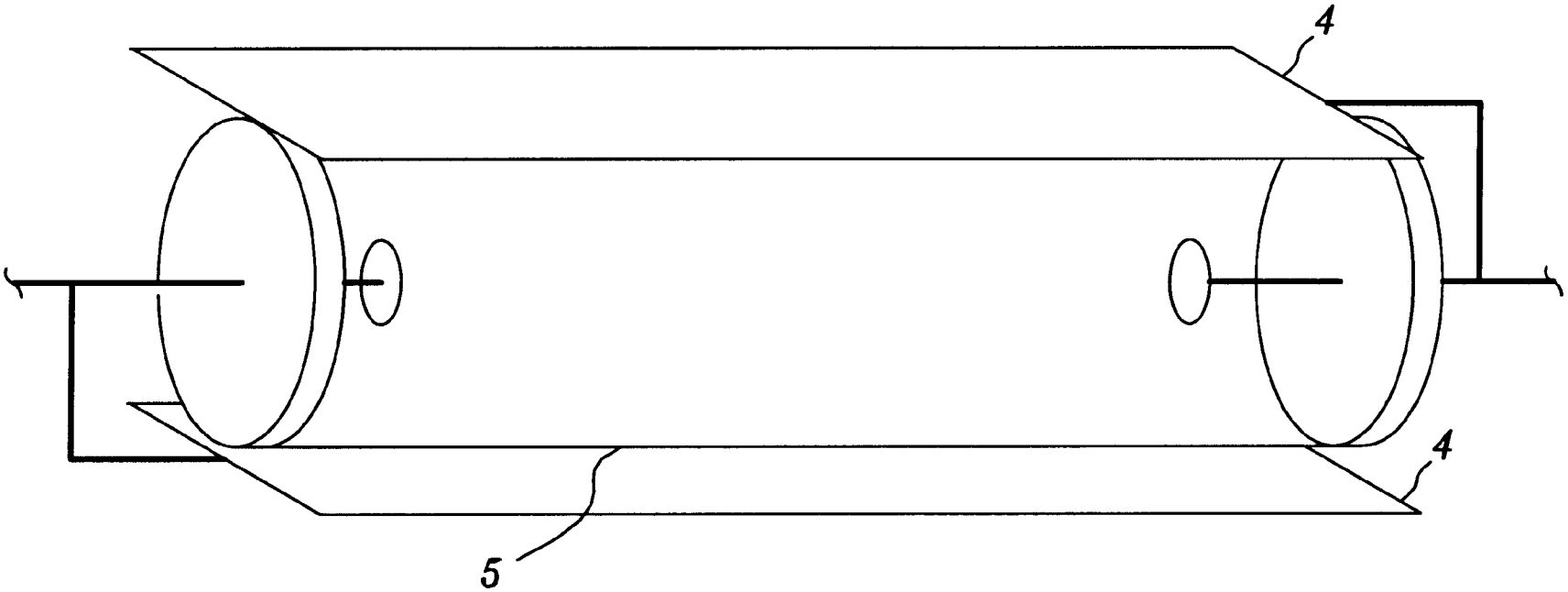
Fig. 2A. PRIOR ART
FIGS. 2A–2C are schematic prior art diagrams, illustrating the use of external plates, wires, and a printed wiring board to produce a transverse electric field in a fluorescent lamp tube.
Figure 2B:
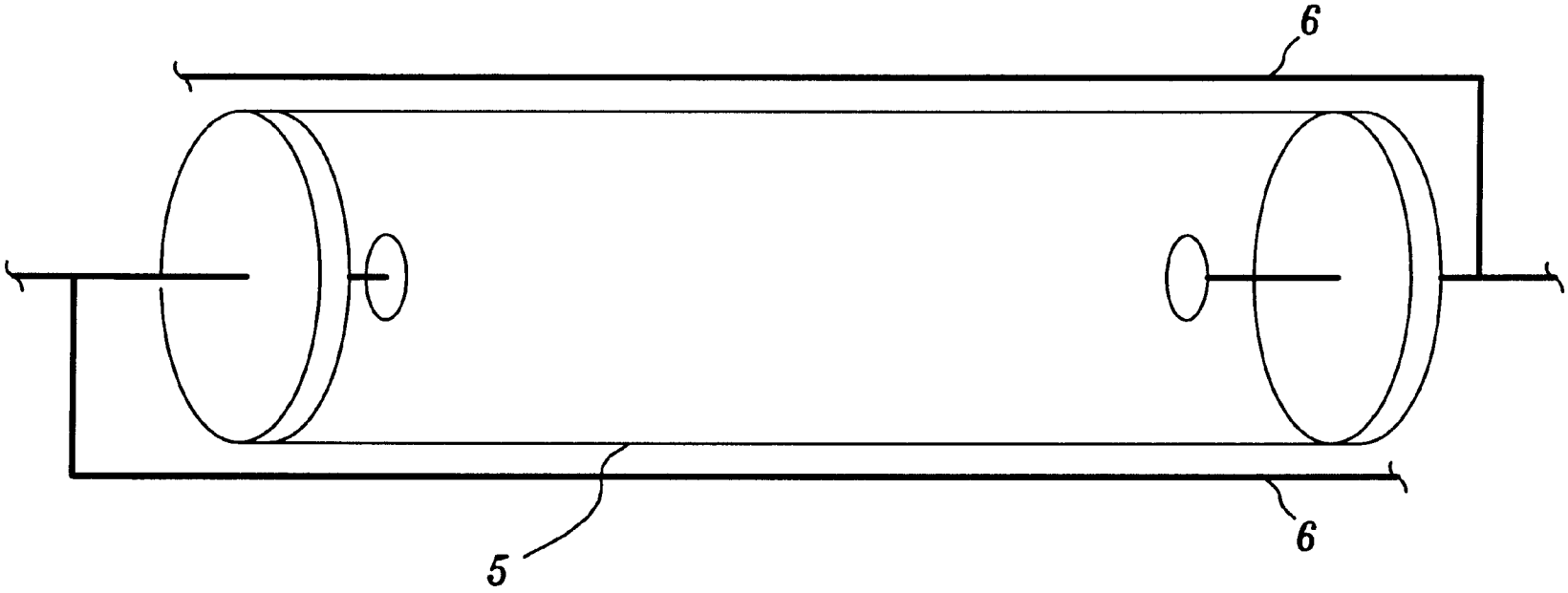
Fig. 2B. PRIOR ART
Figure 2C:
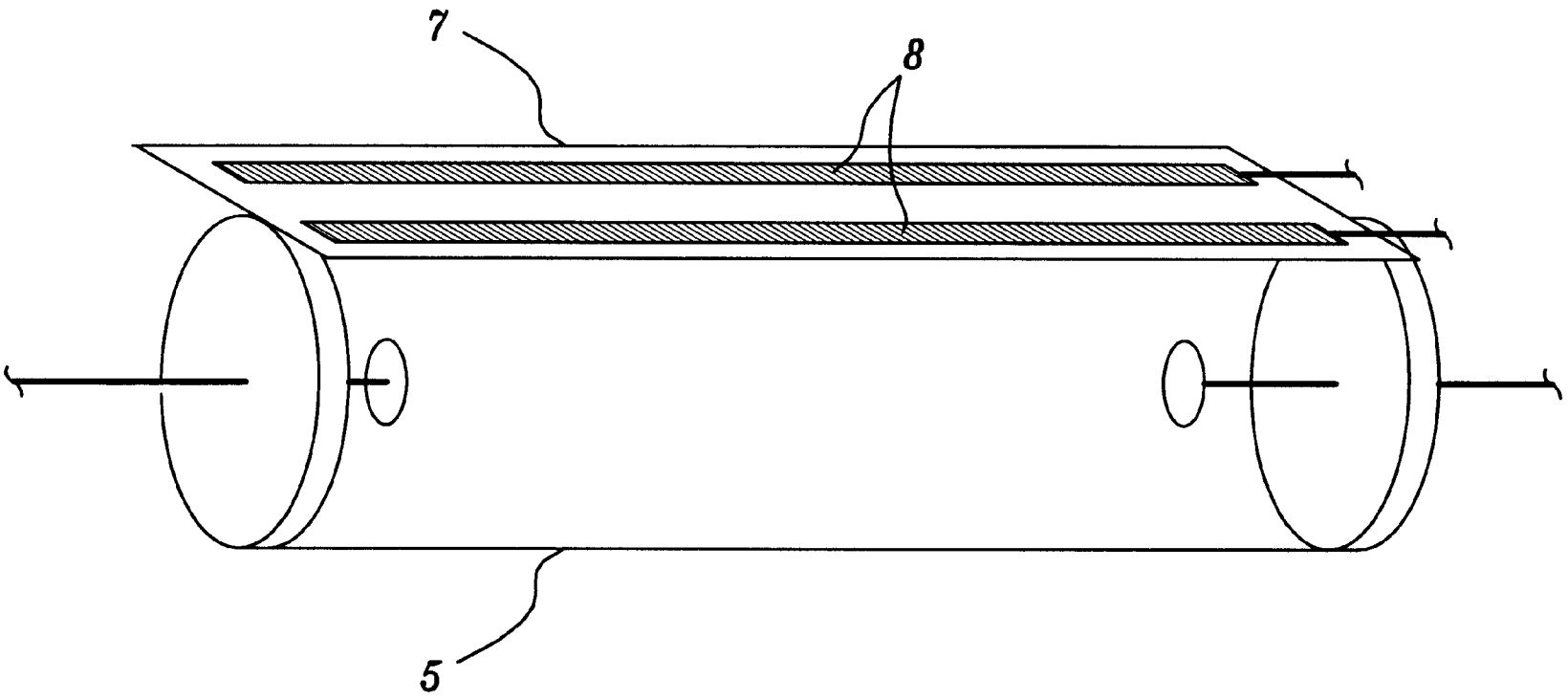
Fig. 2C. PRIOR ART
Figure 3:
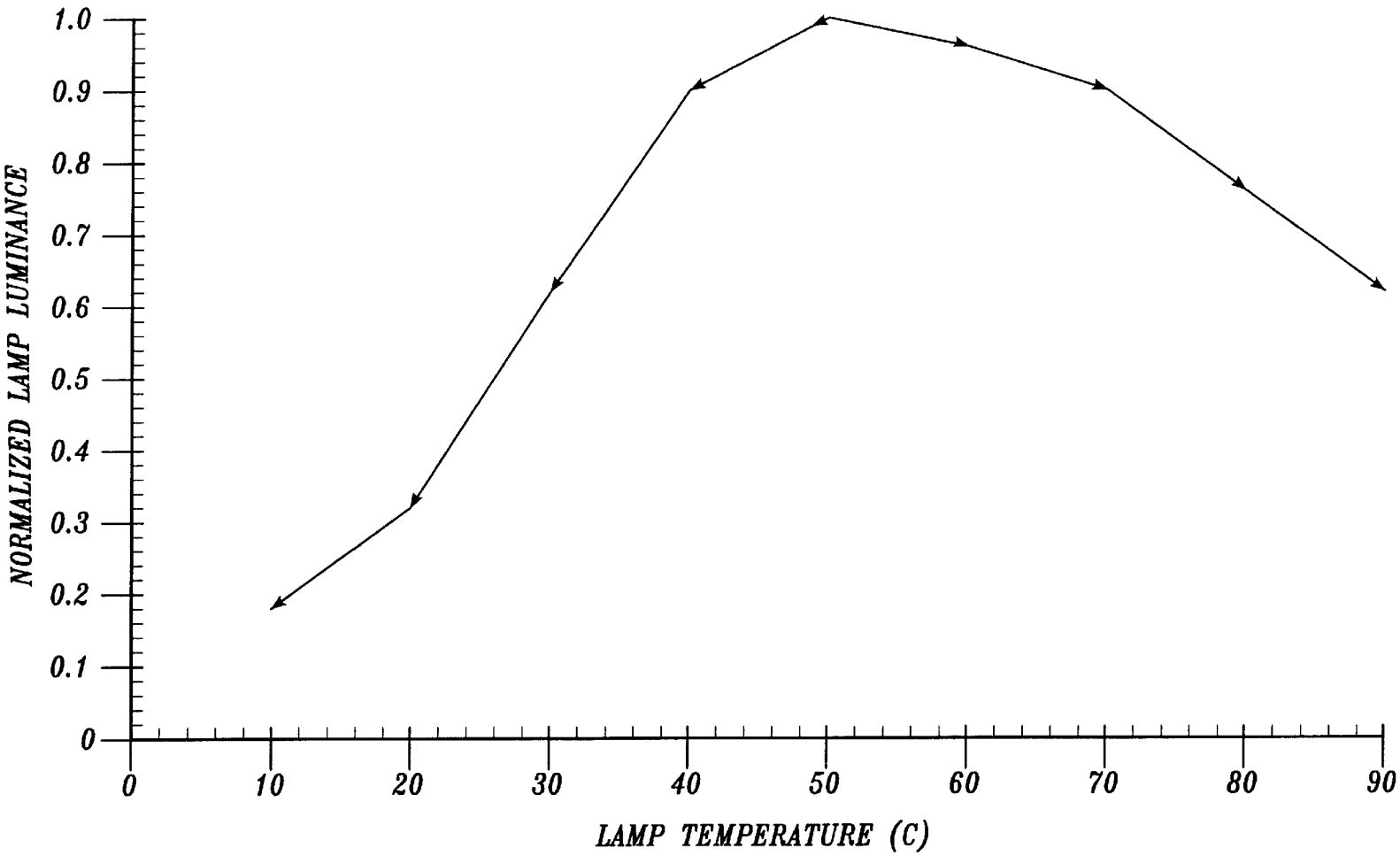
FIG. 3 is a graph showing fluorescent lamp luminosity versus temperature.
Figure 4:
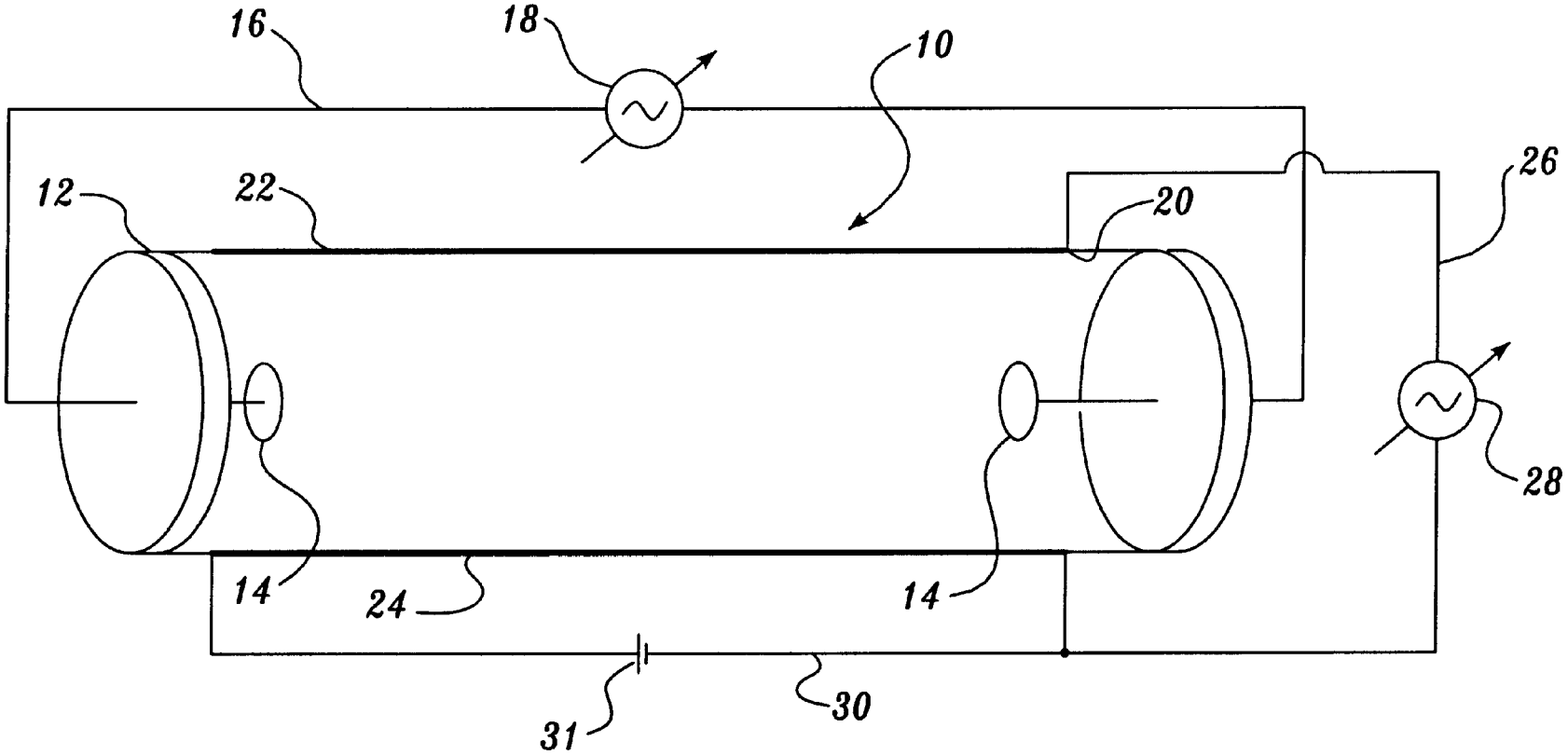
FIG. 4 is a schematic diagram of a fluorescent lamp according to the present invention, wherein conductive traces and internal electrodes are powered separately.

FIG. 4 schematically illustrates a fluorescent lamp according to the present invention. The lamp 10 includes a sealed tube 12 housing a mercury gas mixture. A phosphor layer 20 is deposited on the interior surface of the tube 12. While shown as linear, the tube 12, which is formed of glass, may have other shapes, such as L, U, or serpentine, as known in the art. A pair of internal electrodes 14 are located within the tube 12, at opposite ends thereof. The internal electrodes 14 are electrically connected by a first circuit 16 to a first power supply 18, that produces AC power, as well known in the art. For ease of illustration, and because they are well known and do not form part of this invention, the details of the first power supply and the control system for modulating, i.e., controlling, the output of the first power supply are not disclosed. Depending on implementation, the amplitude of the output of the first power supply can be controlled or the output can be pulse width modulated. In any event, when the first power supply 18 applies a predetermined voltage across the internal electrodes 14, an arc discharge is produced therebetween.

An opposing pair of conductive traces 22, 24 are applied to the exterior surface of the tube 12 along the length of the tube, preferably in the manner described below. The conductive traces form a pair of external electrodes that, when suitably powered, produce an electric field along the length of the tube. More specifically, the conductive traces 22, 24 are electrically coupled by a second circuit 26 to a second power supply 28 that also produces AC power. When the second power supply 28 applies a predetermined voltage across the conductive traces 22, 24, a transverse electric field sufficient to create a low-intensity discharge is produced between the traces. Since the traces lie along the length of the tube, the electric field direction is orthogonal to the axial arc discharge between the internal electrodes 14. As with the first power supply 18, since AC power supplies and control systems for controlling the magnitude of the AC power produced by such power supplies are well known and do not form part of this invention, a specific power supply is not illustrated or described herein.

The conductive traces 22, 24 are applied directly onto the exterior surface of the tube 12. As described more fully below, preferably, the conductive traces 22, 24 are formed by pattern-imprinting (for example, silk-screening) conductive frits onto the glass tube 12, and firing the tube to melt the frits onto the tube. A method of silk-screening conductive traces onto glass surfaces can be found in, for example, U.S. Pat. Nos. 3,813,519; 3,900,634; and 4,958,560. A silver ceramic frit is preferred because silver exhibits excellent conductivity and the resistivity of silver ceramic frits can be readily controlled by controlling the width of such frits. More specifically, a silver ceramic frit comprises precisely ground silver flakes dispersed in an organic binder. The size of the silver flakes and silver content of the frit control the resistivity of the resulting conductive trace and, hence, the power dissipation and heat generation produced by a trace formed of a silver ceramic frit.

At least one of the conductive traces, such as the lower conductive trace 24 shown in FIG. 4, serves not only as an external electrode for producing a transverse electric field but also as a heater. The heating characteristics of the conductive trace 24 are determined, as noted above, by controlling the width and the frit content of the trace, and the current flow through the trace. As illustrated in FIG. 4, the ends of the heater conductive trace 24 are electrically coupled by a third circuit 30 to a third power source 31 that produces DC power.

Though FIG. 4 illustrates only one conductive trace 24 used as a heater, both conductive traces 22, 24 may be connected to the third power supply 30 and used as heaters, if desired. Furthermore, more than two conductive traces may be provided on the exterior surface of the lamp tube, all to be used as heaters, if desired, of which only two such traces are needed as external electrodes to produce the transverse electric field. While providing multiple-trace heaters allows the lamp tube's wall temperature to be raised faster than single or dual trace heaters, because of the increased number of heat sources, multiple-trace heaters have a disadvantage. Specifically, each trace optically blocks light and, thus, reduces the net flux output of the lamp tube. Therefore, for lamps designed for use in LCD or AMLCD backlights, for example, it is preferable to minimize the number of traces, especially on the side of the lamp tube that faces the LCD or AMLCD. Instead, it is preferable to provide a single narrow trace, usable only as an external electrode, on the side of the tube facing the LCD or AMLCD, and a single wide trace, usable both as an external electrode and a heater, on the opposite side of the lamp tube. Alternatively to a single wide trace, the external electrode that forms the heater can follow a "wiggle" path down the "bottom" side of the lamp tube. The trace width and path are obviously determined by the resistivity of the trace required to heat the lamp using the available voltage and power. Preferably, the application of power by the third power source 31 to the conductive trace 24 that forms the heater is controlled by a thermal sensor and switch (not shown), both of which are well known in the art. Alternatively, the thermal switch can be replaced with a controller that, in combination with a temperature sensor, can be used to turn a power switch on or off. The power switch could be a transistor, field-effect transistor (FET), or mechanical solenoid relay, for example.

In FIG. 4, the two conductive traces 22, 24 are shown as straight longitudinal lines. It is to be understood that the conductive traces of the present invention can follow other paths and have varying widths, as long as they are positioned and formed so as to create a transverse electric field that produces a low-intensity discharge adequate to maintain a minimum level of ionization within the gas mixture located in the lamp tube 12. In this regard, it should also be understood that the conductive traces 22, 24 need not be placed exactly opposite each other along the lamp tube 12. The pair of conductive traces may have other relative orientations as long as they produce a sufficiently large transverse electric field between the traces that extends across at least a portion of the glass tube 12.

In operation, the first power supply 18 causes a high-intensity arc discharge to be produced across the internal electrodes 14. This high-intensity arc discharge creates high-intensity light whose magnitude is controlled by controlling the output of the first power supply 18. The second power supply 28 causes a transverse electric field to be produced between the traces 22, 24. The transverse electric field creates a low-intensity discharge that produces dim light when the first power supply is turned off or its output is reduced to the point where the high-intensity arc discharge is removed. The intensity of the dim light is controlled by controlling the output of the second power supply 28. The optimal voltage to be applied to the traces is based on the selected transverse electric field frequency (typically between 10 KHz and 100 KHz), the transverse distance, i.e., the diameter of the lamp tube, and the gas species. For example, a voltage of 500 V applied to the traces has been found satisfactory to sustain a transverse electric field in a 15 mm diameter tube with 4 Torr of Ar, operated at a frequency of 10 KHz.

During high-intensity operation, it is desirable to maintain the low-intensity transverse field by continuing to apply power to the conductive traces 22, 24, because the transverse field helps to sustain the proper ionization level within the gas mixture and provides stable arc discharge conditions.

The power produced by the third power supply 31 causes the connected conductive trace to heat up, thereby warming up the lamp tube wall. Typically, 28 VDC or so is applied to the conductive trace that is also used as a heater. When a predetermined temperature is achieved, a suitable thermal control system (described above) turns off the heater by turning off the third power supply 31.

Figure 5:
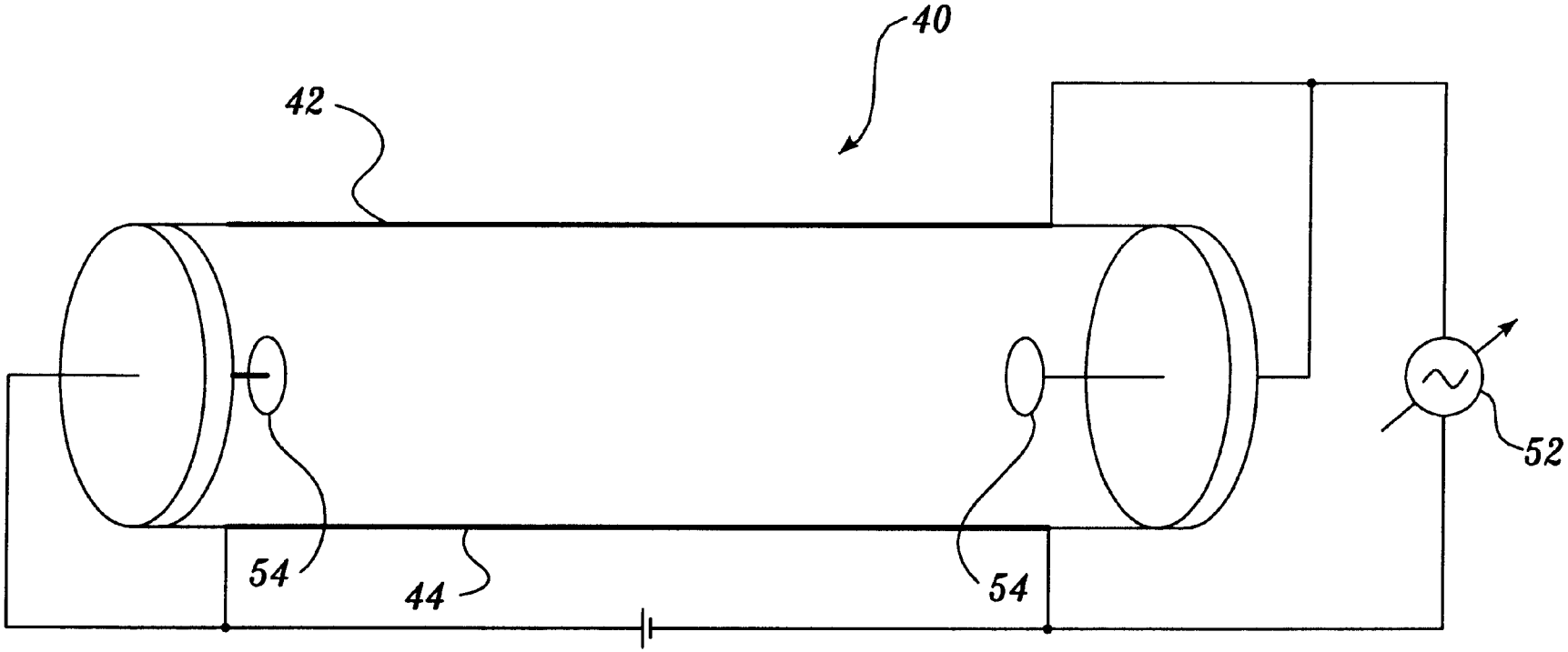
FIG. 5 is a schematic diagram of a fluorescent lamp according to the present invention, wherein conductive traces and internal electrodes are powered by a common power supply.
Figure 6:
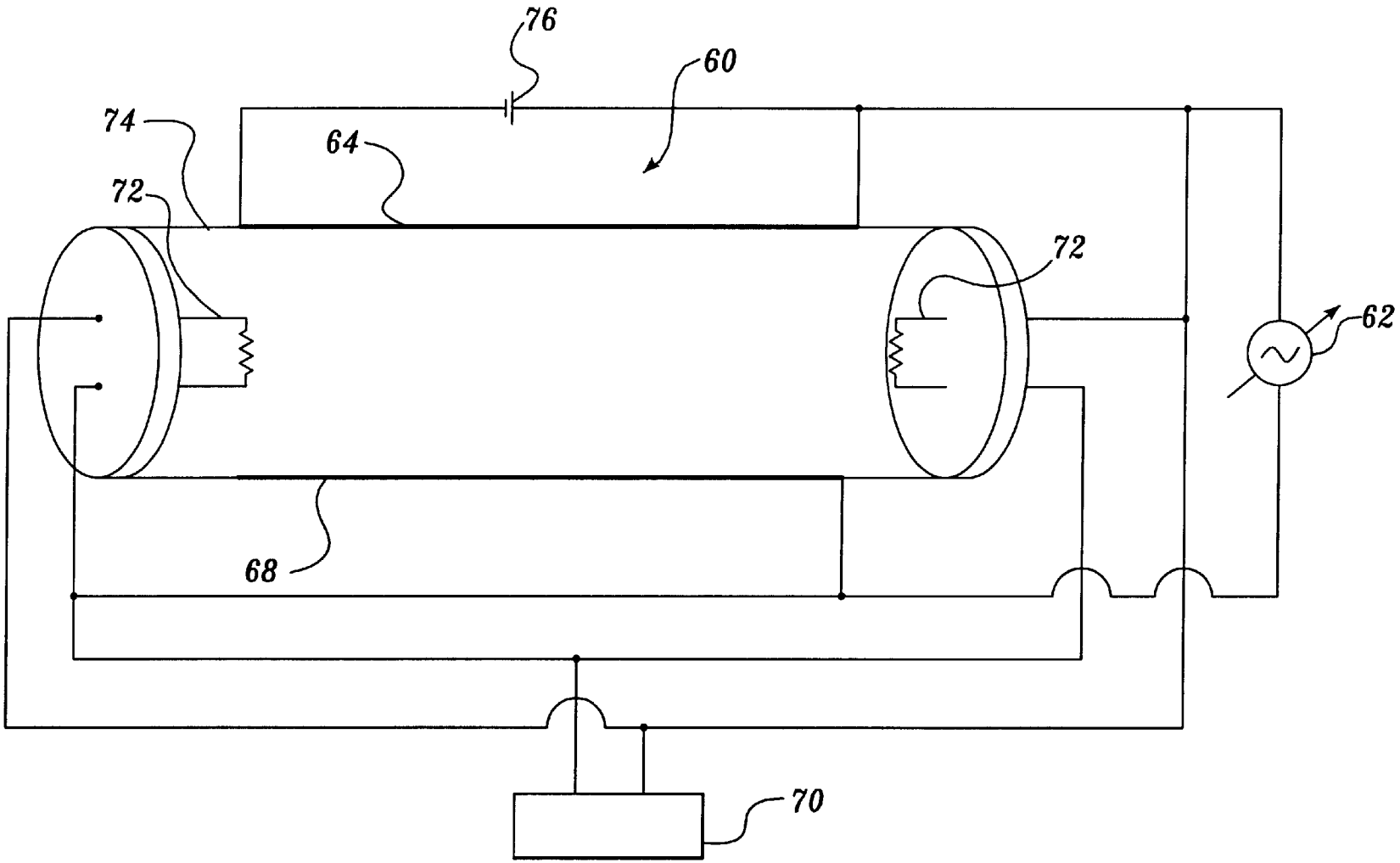
FIG. 6 is a schematic diagram of a fluorescent lamp according to the present invention that includes a hot cathode tube.

FIGS. 5–6 illustrate alternative embodiments of a fluorescent lamp formed in accordance with the present invention. FIG. 5 illustrates a fluorescent lamp 40 wherein a pair of conductive traces 42, 44 and a pair of internal electrodes 54 similar to those illustrated in FIG. 4 and described above are connected in parallel with each other. The parallel connected traces and internal electrodes are connected to a single AC power source 52. The single AC power source 52 thus supplies power for both the low-intensity transverse field between the conductive traces 42, 44, and the high-intensity arc discharge between the internal electrodes 54. As with FIG. 4, a DC power supply 55 is included to provide heater power to one of the traces 44.

FIG. 6 illustrates a fluorescent lamp 60 formed in accordance with the present invention wherein hot cathodes replace the internal electrodes. As with the embodiment of the invention shown in FIG. 4 and described above, an AC power source 62 supplies power that produces a low-intensity electric field across a pair of conductive traces 64, 68. A filament power supply 70 supplies power to the hot cathodes, which are formed by two filaments 72 located at opposite ends of a glass tube 74. In a conventional manner, current flow through the filaments causes the filaments to heat and emit electrons. The AC power source 62 also provides excitation for arc discharge between the two filaments 72. As before, one of the conductive traces 64 is connected to a third power supply 76 and functions as a heater.

Figure 7:
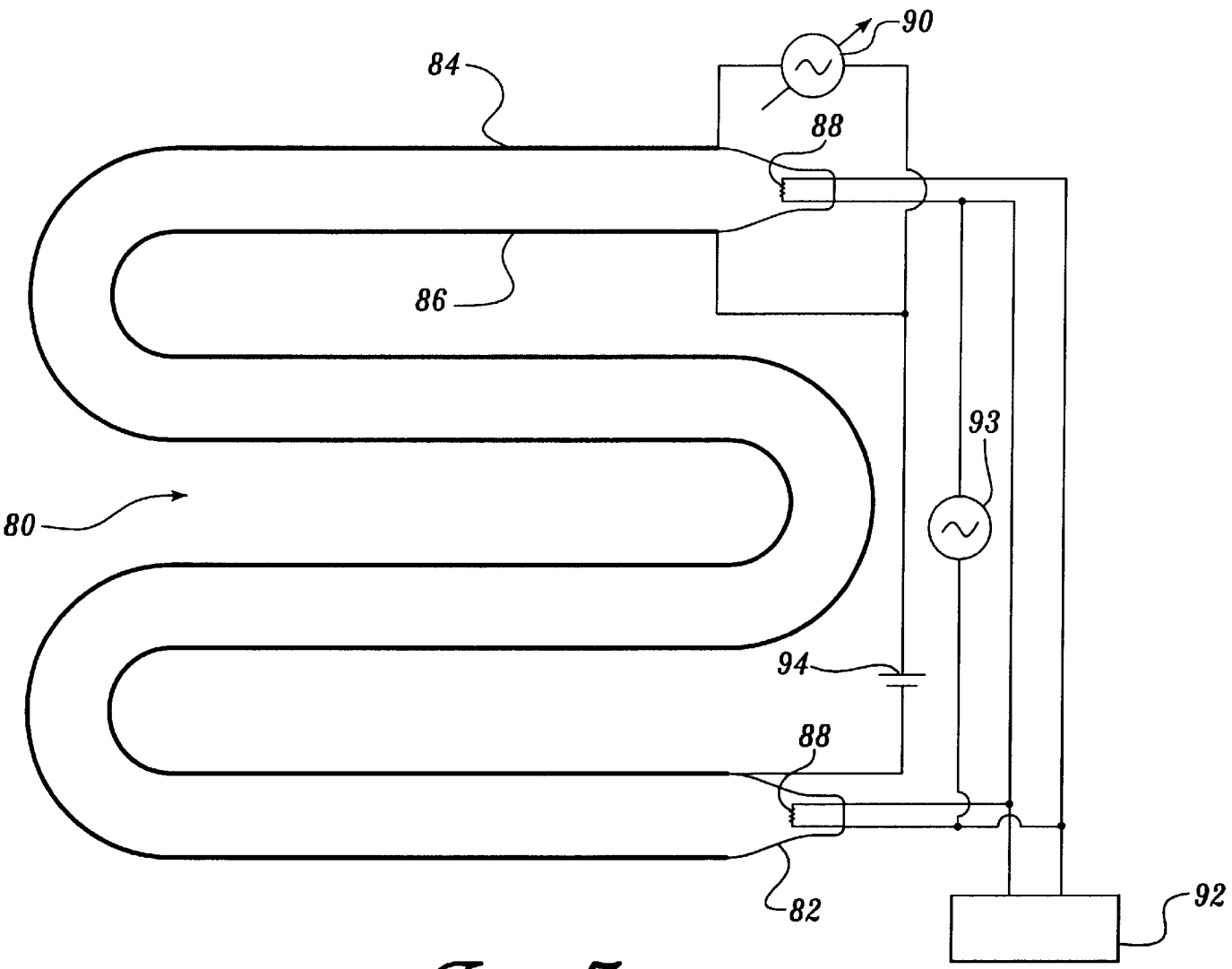
FIG. 7 is a schematic diagram of a fluorescent lamp according to the present invention wherein the lamp tube has a serpentine shape.

FIG. 7 illustrates a fluorescent lamp 80 formed in accordance with the invention wherein the fluorescent lamp tube 82 has a serpentine shape. As with other embodiments of the invention described above, a pair of conductive traces 84, 86 are provided on the exterior surface of the tube 82. Also, as with other embodiments of the invention described above, the conductive traces span substantially the entire length of the serpentine-shaped tube 82, on opposite sides thereof. Filament-type cathodes 88 are located in each end of the tube 82. A first (AC) power supply 90 is connected to the traces 84 and 86. As with other embodiments of the invention, the first power supply 28 produces power sufficient for a low-intensity electric field to be produced in the tube, between the traces. A second power supply 92 is connected to and supplies power to the cathodes 88. As with the FIG. 6 embodiment of the invention, the second power supply causes a current flow through the cathodes 88 sufficient to cause the cathodes to emit electrons. A third (AC) power supply 93 connected across the two filament-type cathodes 88 provides excitation for the arc discharge between the two filament-type cathodes 88. A fourth (DC) power supply 94 is connected to opposite ends of one of the traces 86. As with the other embodiments of this invention described above, the current flow through this trace 86 caused by the fourth power supply, in combination with the resistance of the trace, causes the trace to form a heater.

A fluorescent lamp formed in accordance with this invention not only has a dimming range with a lower limit than prior art fluorescent lamps, it also has a uniform luminance level at all dimming levels. The luminance level is uniform because the electric field and ionization of the gas mixture are uniform throughout the length of the fluorescent lamp tube. This feature is particularly advantageous when the lamp is used for backlighting an LCD or an AMLCD. LCD and AMLCD backlights are required to provide a uniform luminance level at all dimming levels so that the resulting display luminance is uniform.

Since the conductive traces of a fluorescent lamp formed in accordance with this invention are directly applied on the exterior surface of the tube, the traces exhibit superior heat transfer rate when used as heaters as compared to resistive wire wrapped around a fluorescent lamp tube. For the same power consumption, this superior heat transfer rate shortens warmup time when compared to resistive wire heaters. Rapid warmup time is particularly important in equipment intended for possible use in cold climates such as military aircraft instrument displays. As more fully described below, preferably, the conductive traces are pattern-imprinted directly onto the exterior surface of the lamp tube and then the lamp tube is fired. This relatively uncomplex manufacturing process produces a highly durable lamp, which is especially important when the lamp tube has a complex shape.

Referring back to FIG. 4, the presently preferred method of forming a fluorescent lamp with integral conductive traces is next described in more detail. The method involves applying the pair of conductive traces 22, 24, to the exterior surface of the glass tube 12 along the length of the tube 12, opposite each other. Preferably, the conductive traces are applied using conventional glass silk-screen technology. More specifically, conventional glass silk-screen technology is used to apply a pair of silver or other conductive material frits onto the outer surface of the tube at suitable locations. Thereafter, the glass tube is fired to melt the frit onto the wall of the tube. Then, a phosphor layer is applied to the interior surface of the glass tube, a fluorescent gas mixture is injected into the tube, and the tube is sealed, all in a conventional manner. It is preferable to first apply the conductive frits to the exterior surface of the fluorescent lamp tube and fire the tube before applying the phosphor coating in order to avoid damaging the phosphor coating. In this regard, as well known to those skilled in the manufacture of fluorescent tubes, a suitable phosphor coating is produced by mixing a phosphor material with an organic binder to form a slurry, flowing the slurry through the interior of the glass tube, drying the slurry, and firing the glass tube to remove the organic binder. It is known that the luminous efficiency of phosphor can be affected if exposed to high temperatures, approximately above 600° C. The temperature required to melt a silver frit silk-screened onto a glass tube into the tube is typically significantly higher than 600° C. Thus, silk-screening conductive frits to a glass tube that is already phosphor coated and then heating the tube to a frit-melting temperature could be detrimental to the phosphor coating. Accordingly, it is preferable to apply the conductive traces before applying the phosphor coating.

As known in the art, fluorescent lamp tubes are normally shaped prior to the application of a phosphor material. More specifically, a fluorescent lamp tube is formed by first heating and then bending an uncoated glass tube into the desired form—serpentine, circular, U-shaped, L-shaped, etc. After being formed, the interior of the glass tube is coated with a phosphor material. This process is termed the coat-after-bend process in the fluorescent tube manufacturing arts. The presently preferred method of the invention employs the coat-after-bend process, except that the conductive frits are pattern-imprinted onto the exterior surface of the bent glass tube and the tube subsequently fired before the phosphor coating is applied to the interior surface of the tube. This procedure allows the conductive traces to be formed without damaging the phosphor coating.

While the presently preferred embodiments of the invention have been illustrated and described, it is to be understood that within the scope of the appended claims, various changes can be made therein without departing from the spirit of the invention.

The embodiments of the invention in which an exclusive property or privilege is claimed are defined as follows:

1. In a fluorescent lamp comprising a lamp tube, having an interior surface coated with a phosphor layer, a fluorescent gas mixture located within the lamp tube and a mechanism for causing the release of electrons in the tube for exciting the gas mixture in order to ionize some of the gas mixture molecules to upper energy levels so that ultraviolet radiation is produced, said ultraviolet radiation causing said phosphor layer to emit light when said ultraviolet radiation strikes said phosphor layer, the improvement comprising:

first and second conductive traces located on the exterior surface of said lamp tube opposite one another, along the length of said lamp tube; and a power supply connected to said first and second conductive traces for causing said first and second conductive traces to produce a transverse electric field along the length of said lamp tube, said transverse electric field producing a low-intensity discharge sufficient to cause said fluorescent lamp to produce light when said mechanism for causing the release of electrons no longer produces sufficient electrons for said lamp tube to emit light.

2. The improvement claimed in claim 1, wherein the first and second conductive traces are pattern-imprinted onto the exterior surface of the lamp tube.

3. The improvement claimed in claim 2, wherein the first and second conductive traces are formed by conductive frits.

4. The improvement claimed in claim 3, wherein said conductive frits include silver.

5. The improvement claimed in claim 1, wherein the resistivity of at least one of said conductive traces is sufficient for said at least one conductive trace to form a heater and including a further power supply for supplying power to said at least one conductive trace to produce heat.

6. The improvement claimed in claim 5, wherein the first and second conductive traces are pattern-imprinted onto the exterior surface of the lamp tube.

7. The improvement claimed in claim 6, wherein the first and second conductive traces are formed by conductive frits.

8. The improvement claimed in claim 7, wherein said conductive frits include silver.

9. The improvement claimed in claim 1, wherein said lamp tube has a nonlinear shape.

10. The improvement claimed in claim 9, wherein the first and second conductive traces are pattern-imprinted onto the exterior surface of the lamp tube.

11. The improvement claimed in claim 10, wherein the first and second conductive traces are formed by conductive frits.

12. The improvement claimed in claim 11, wherein said conductive frits include silver.

13. The improvement claimed in claim 9, wherein the resistivity of at least one of said conductive traces is sufficient for said at least one conductive trace to form a heater and including a further power supply for supplying power to said at least one conductive trace to produce heat.

14. The improvement claimed in claim 13, wherein the first and second conductive traces are pattern-imprinted onto the exterior surface of the lamp tube.

15. The improvement claimed in claim 14, wherein the first and second conductive traces are formed by conductive frits.

16. The improvement claimed in claim 15, wherein said conductive frits include silver.

17. The improvement claimed in claim 9, wherein the nonlinear shape is serpentine.

18. The improvement claimed in claim 17, wherein the first and second conductive traces are pattern-imprinted onto the exterior surface of the lamp tube.

19. The improvement claimed in claim 18, wherein the first and second conductive traces are formed by conductive frits.

20. The improvement claimed in claim 19, wherein said conductive frits include silver.

21. The improvement claimed in claim 17, wherein the resistivity of at least one of said conductive traces is sufficient for said at least one conductive trace to form a heater and including a further power supply for supplying power to said at least one conductive trace to produce heat.

22. The improvement claimed in claim 21, wherein the first and second conductive traces are pattern-imprinted onto the exterior surface of the lamp tube.

23. The improvement claimed in claim 22, wherein the first and second conductive traces are formed by conductive frits.

24. The improvement claimed in claim 23, wherein said conductive frits include silver.

25. A method of forming a fluorescent lamp tube suitable for use in a wide dimming range fluorescent lamp, said method comprising:

providing a lamp tube having an interior surface and an exterior surface;

applying first and second opposed conductive traces to the exterior surface of the lamp tube along the length of the lamp tube;

forming a phosphor layer on the interior surface of the lamp tube;

injecting a fluorescent gas mixture inside the lamp tube; and sealing the lamp tube.

26. The method of claim 25, wherein the conductive traces are pattern-imprinted onto the exterior surface of said lamp tube.

27. The method of claim 26, wherein said lamp tube is fired after said conductive traces are pattern-imprinted onto the exterior surface of said lamp tube, prior to said phosphor layer being formed.

28. The method of claim 25, wherein said conductive traces are formed by conductive frits.

29. The method of claim 28, wherein the conductive traces are pattern-imprinted onto the exterior surface of said lamp tube.

30. The method of claim 28, wherein said conductive frits include silver.

31. The method of claim 30, wherein the conductive traces are pattern-imprinted onto the exterior surface of said lamp tube.

32. The method of claim 25, wherein the resistivity of at least one of said conductive traces is sufficient for said conductive trace to form a heater for said lamp tube when current flows through said at least one of said conductive traces.

33. The method of claim 32, wherein the conductive traces are pattern-imprinted onto the exterior surface of said lamp tube.

34. The method of claim 33, wherein said lamp tube is fired after said conductive traces are pattern-imprinted onto the exterior surface of said lamp tube, prior to said phosphor layer being formed.

35. The method of claim 33, wherein said conductive traces are formed by conductive frits.

36. The method of claim 35, wherein said conductive frits include silver.

* * * * *